United States Patent [19]

Jeavons et al.

[11] 4,177,606

[45] Dec. 11, 1979

[54] REGULATOR ASSEMBLIES

[75] Inventors: Philip S. Jeavons; Sidney E. Fisher, both of Birmingham, England

[73] Assignee: Wilmot-Breeden Limited, Birmingham, England

[21] Appl. No.: 829,580

[22] Filed: Aug. 31, 1977

[30] Foreign Application Priority Data

Aug. 31, 1976 [GB] United Kingdom ..... 36041/76

[51] Int. Cl.[2] ..... E05F 11/44

[52] U.S. Cl. ..... 49/351

[58] Field of Search ..... 49/351, 350

[56] References Cited

U.S. PATENT DOCUMENTS

| | | | |
|---|---|---|---|
| 2,385,676 | 9/1945 | Axe | 49/351 X |
| 2,478,523 | 8/1949 | Cadwallader | 49/351 |
| 2,850,333 | 9/1958 | Hamman | 49/351 X |
| 3,888,047 | 6/1975 | Chikaraishi | 49/351 |
| 3,897,652 | 8/1975 | Hess | 49/351 |

*Primary Examiner*—Philip C. Kannan

*Attorney, Agent, or Firm*—Young & Thompson

[57] ABSTRACT

A window regulator assembly comprises a pair of pivotally interconnected window lifting arms, one of which is pivoted to a panel plate and has a toothed segment attached thereto. The segment engages a pinion driven by a handle and controlled by a clutch, and is cut from strip material by a cropping operation which simultaneously forms teeth in the trailing edge of one segment and the leading edge of the following segment.

4 Claims, 2 Drawing Figures

10
11
12
13
14
15
16
17
18
19
20
21
22
23
24
25
P

REGULATOR ASSEMBLIES

This invention relates to regulator assemblies for the windows of motor vehicles and is concerned with the provision of an improved assembly for mounting within the door of a vehicle.

According to the invention a window regulator assembly comprises a pair of pivotally interconnected lifting arms for action between the window and a door panel of the vehicle in the manner of a scissors linkage, a panel plate for attachment to the door panel at a plurality of spaced positions one of which is constituted by a pivotal mounting for one of the lifting arms whereby the pivotal interconnection of the panel plate and the said lifting arm serves also as an attachment means for attaching the panel plate to the door panel, a toothed segment fixedly carried by said lifting arm and a pinion carried by the panel plate in mesh with the teeth of said segment whereby rotation of the pinion serves to effect pivotal movement of the said lifting arm relative to the panel plate and thus, in use, opening or closing movement of the window.

The method of attachment of the regulator assembly to the door panel is preferably such that the end portion of said lifting arm adjacent the toothed segment is sandwiched between the panel plate and the door panel, the panel plate and door panel effectively cooperating to form a box section within which said lifting arm end portion is pivotally mounted.

The pinion is preferably associated with a clutch and clutch spring mounted in a housing fixed to the panel plate with the pinion mounted on a shaft carrying an adaptor plate having means for driving connection with an operating handle for the regulator assembly.

Production of the toothed segment is preferably effected by a cropping operation in which metal strip is subjected to cropping processes during intermittent advancing movement of the strip such that the formation of the teeth along the leading edge of a segment is effected simultaneously with separation of that segment from a preceding segment. As a result tooth formations are provided along the leading and trailing edges of each segment.

The invention will now be described, by way of example, with reference to a motor vehicle window regulator assembly which is shown in the accompanying drawings, in which.

Figures 1, 2:
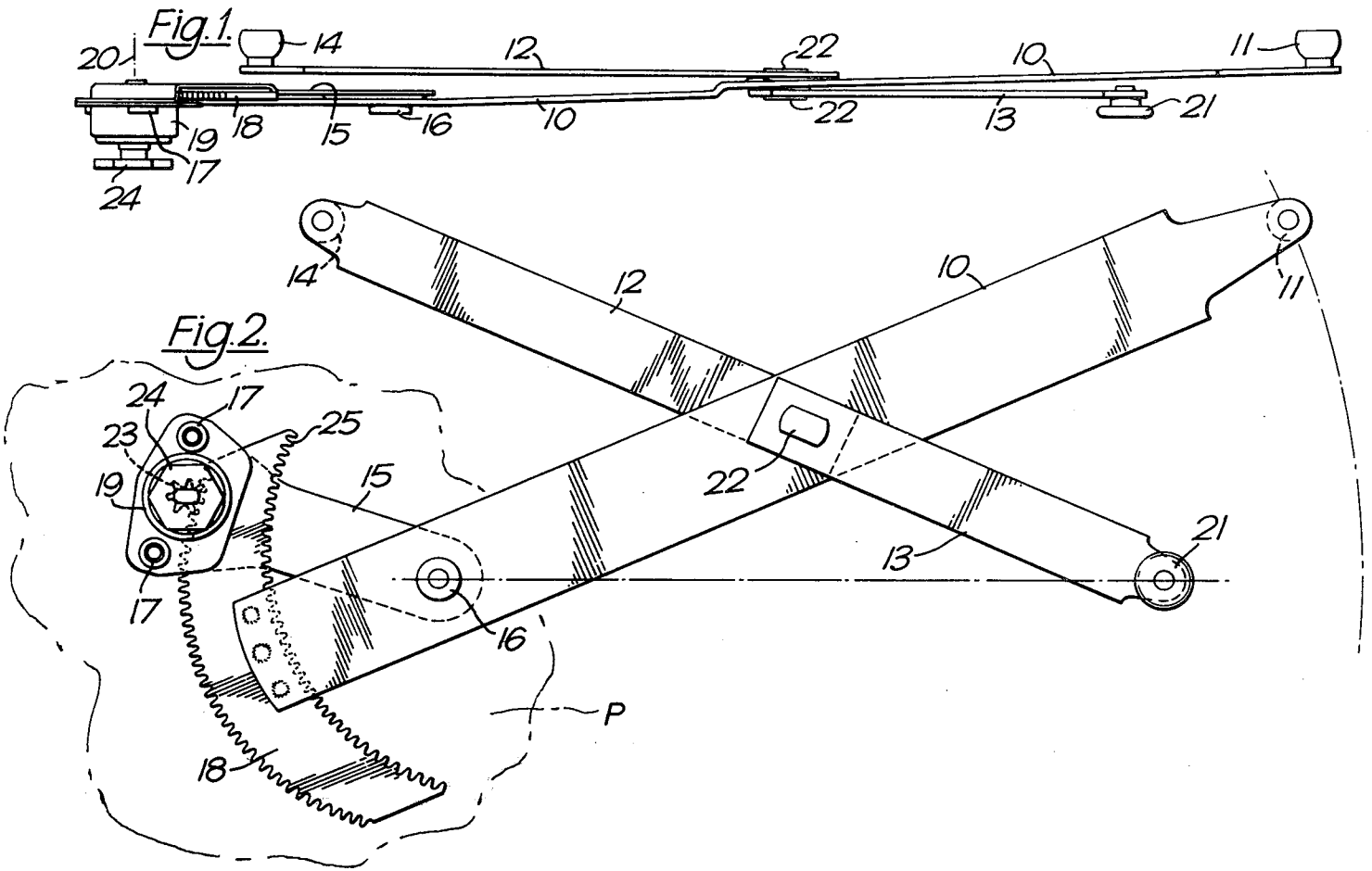
FIG. 1 is a plan view of the regulator assembly.
FIG. 2 is a side view of the regulator assembly.

The regulator assembly includes a main lifting arm 10 which, as shown in FIG. 1, is cranked intermediate its ends and is provided at its upper end with a roller 11. The main arm 10 is pivotally connected to a second arm which is formed in two portions 12 and 13, one disposed on each side of the main arm 10 and each provided at its free end with a roller 14, 21 respectively. The arm portions 12 and 13 are interconnected by a pin or rivet 22 passing through an aperture in the main arm 10 such that they remain in alignment during pivotal movement thereof relative to the main arm 10, so that the arms function in the manner of a scissors linkage to effect raising and lowering of a vehicle window associated with the rollers 11 and 14 upon relative pivotal movement between the arms.

A panel plate 15 is attached to the main arm 10 by means of a pivot pin 16 to which a clinch nut is secured, the pivot pin also being used to attach the panel plate 15 to a vehicle door panel with the main arm 10 sandwiched between the panel plate 15 and the door panel. The panel plate 15 is also provided with a pair of apertures to receive fasteners 17 including clinch nuts to provide a 3-point mounting for the panel plate 15.

At the lower end of the main arm 10 there is a toothed segment 18 which is welded to the arm 10. The segment 18 is arranged for engagement by the teeth of a driving pinion 23 carried by the panel plate 15. The driving pinion 23 is contained within a cover 19 and rotates about an axis 20 upon rotation of a handle (not shown) connected directly, or indirectly by means of an adaptor plate 24, to the pinion shaft. The cover 19 also houses a spring-loaded clutch for the pinion 23 to prevent overloading thereof.

The method of manufacture of the regulator assembly involves production of the main arm 10, arm portions 12 and 13 and panel plate 15 as pressings whereas the toothed segment 18 is cropped from flat metal strip with the cropping operation serving to form teeth 25 along the trailing edge of a segment simultaneously with the formation of teeth along the leading edge of the following segment. Although the trailing edge teeth 25 serve no useful function, this method of production involves only one cropping operation for each segment and thus enables increased productivity to be obtained.

An important advantage of the regulator assembly is that the dimensions of the panel plate 15 are much less than the dimensions of the panel plates of the regulator assemblies at present in use so that considerable saving of materials is obtained. In addition, the particular design is such as to facilitate attachment of the regulator assembly to a door panel.

We claim

1. A vehicle window regulator assembly comprising two pivotally interconnected lifting arms acting between a window and a door panel of the vehicle in the manner of a scissors linkage, a panel plate attached to the door panel by a plurality of spaced fasteners one of which provides a pivotal interconnection between the panel plate and one of the lifting arms, a toothed segment carried by an end portion of said one lifting arm, which end portion is sandwiched between the panel plate and the door panel, and a pinion carried by the panel plate in mesh with the teeth of said segment whereby rotation of the pinion serves to effect pivotal movement of said lifting arm relative to the panel plate and thus, in use, opening or closing movement of the window.

2. A vehicle window regulator assembly according to claim 1, wherein the panel plate is attached to the door panel by three fasteners.

3. A vehicle window regulator assembly comprising two pivotally interconnected lifting arms acting between a window and a door panel of the vehicle in the manner of a scissors linkage, a toothed segment carried by an end portion of one of said lifting arms, a panel plate attached to the door panel with the end portion of said lifting arm and the toothed segment interposed between the panel plate and the door panel with the arrangement such that the panel plate and the door panel cooperate to form a box section within which said lifting arm end portion is located, a pinion carried by the panel plate in mesh with the teeth of said segment and means for rotating the pinion to effect pivotal movement of said lifting arm relative to the panel plate and thus, in use, opening or closing movement of the window.

4. A vehicle window regulator assembly according to claim 3, wherein the panel plate is attached to the door panel by three fasteners one of which provides a pivotal connection between the panel plate and the lifting arm on which the toothed segment is carried.

* * * * *